US012276460B2

(12) United States Patent
Chen et al.

(10) Patent No.: US 12,276,460 B2
(45) Date of Patent: Apr. 15, 2025

(54) MODULAR HEAT EXCHANGER

(71) Applicants: Tsung-Ming Chen, Taipei (TW); Chun-Yu Chen, Taipei (TW)

(72) Inventors: Tsung-Ming Chen, Taipei (TW); Chun-Yu Chen, Taipei (TW)

( * ) Notice: Subject to any disclaimer, the term of this patent is extended or adjusted under 35 U.S.C. 154(b) by 292 days.

(21) Appl. No.: 18/072,973

(22) Filed: Dec. 1, 2022

(65) Prior Publication Data

US 2023/0175782 A1 Jun. 8, 2023

(30) Foreign Application Priority Data

Dec. 6, 2021 (TW) ..... 110145493

(51) Int. Cl.

| | |
|---|---|
| ***F24F 5/00*** | (2006.01) |
| ***B60H 1/00*** | (2006.01) |
| ***F28D 1/02*** | (2006.01) |
| ***F28F 1/30*** | (2006.01) |

(52) U.S. Cl.

CPC ..... *F28D 1/0246* (2013.01); *F28F 1/30* (2013.01); *F28D 2001/0266* (2013.01)

(58) Field of Classification Search

CPC ..... F25B 2321/02; F25B 2321/025; F25B 2321/023; F25B 2321/0251; F25B 2321/0252; F24F 5/0042; B60H 1/00478

See application file for complete search history.

(56) References Cited

U.S. PATENT DOCUMENTS

| | | | | |
|---|---|---|---|---|
| 9,360,514 | B2 * | 6/2016 | Phan | G01R 31/003 |
| 10,533,785 | B2 * | 1/2020 | Ma | F25B 21/02 |
| 2006/0048519 | A1 * | 3/2006 | Childress | F25B 21/04 62/3.3 |
| 2006/0075758 | A1 * | 4/2006 | Rice | F25B 21/04 62/434 |
| 2006/0180703 | A1 * | 8/2006 | Zielinski | F28D 7/0066 244/57 |

(Continued)

FOREIGN PATENT DOCUMENTS

| | | | |
|---|---|---|---|
| CN | 101865556 | A | 10/2010 |
| CN | 206977889 | U | 2/2018 |

(Continued)

*Primary Examiner* — Frantz F Jules
*Assistant Examiner* — Jason N Thompson
(74) *Attorney, Agent, or Firm* — Best & Flanagan LLP

(57) ABSTRACT

A modular heat exchanger includes: two finned heat sinks, each finned heat sink has multiple guiding plates and a mounting recess; a securing assembly for securing the two finned heat sinks; a heat conduction pipe mounted in the mounting recesses; multiple modular blocks linearly arranged, and each modular block has multiple inlet through holes and multiple outlet through holes; multiple water pipes, each water pipe has two ends mounted through the inlet through holes and the outlet through holes respectively; and multiple coolers mounted to an outer sidewall defined on at least one of the modular blocks. It is convenient to assemble, disassemble or expand the modular heat exchanger, so as to improve performance of the modular heat exchanger. When one of the coolers fails, it is able to reach and detach said failed cooler by disassembling some parts of the modular heat exchanger, which is convenient.

6 Claims, 5 Drawing Sheets

(56) References Cited

U.S. PATENT DOCUMENTS

| | | | | |
|---|---|---|---|---|
| 2011/0271994 | A1* | 11/2011 | Gilley | H10N 10/13 165/185 |
| 2017/0108252 | A1* | 4/2017 | Lee | F28D 1/024 |
| 2023/0251000 | A1* | 8/2023 | Prouty | F25B 21/02 62/3.6 |

FOREIGN PATENT DOCUMENTS

| | | | |
|---|---|---|---|
| CN | 109974332 | A | 7/2019 |
| KR | 20020010330 | A | 2/2002 |
| TW | I739131 | B | 9/2021 |
| TW | M624572 | U | 3/2022 |

* cited by examiner

MODULAR HEAT EXCHANGER

BACKGROUND OF THE INVENTION

Field of the Invention

The present invention relates to a heat exchanger, especially to a modular heat exchanger.

Description of the Prior Art(s)

An air conditioner, such as an air conditioner for providing cool air, includes an evaporator, a compressor, a condenser and an expansion valve. During processes of installation, using and repairing, it takes a lot of time to install the air conditioner with a complex structure, resulting in increased costs in manufacturing and installation. Moreover, refrigerant inside the air conditioner may leak due to aging pipelines or other reasons. The refrigerant discharged outdoors causes damage to the ozone layer that protects the earth from ultra-violet radiation. The natural environment would be damage accordingly. In addition, during operation of compressor, it is power consuming and noisy.

Therefore, a conventional modular heat exchanging device as disclosed in Taiwan Patent No. 1739131 includes a base, a water pipe, multiple coolers and a sleeve. The base is formed as a rectangular cylinder, is hollow and has two end openings, multiple guiding plates, a first venting hole and a second venting hole. The end openings are formed on two opposite ends of the base. The guiding plates are formed inside the base and are separately arranged between the two end openings of the base. The first venting hole is formed through a sidewall of the base. The second venting hole is also formed through the sidewall of the base. The water pipe is tubular. The coolers are mounted to an outer side surface of the water pipe. The sleeve is tubular. The water pipe is mounted through the sleeve, the coolers abut against an inner side surface of the sleeve, and the sleeve is mounted through the base. The coolers adjust temperature of gas or liquid that flows through the conventional modular heat exchanging device, such that the conventional modular heat exchanging device can be assembled with ease and can be operated without air pollution or noise.

However, when any one of the coolers in the conventional modular heat exchanging device fails and needs to be repaired or replaced, since the coolers are held between the water pipe and the sleeve, it has to disassemble the whole conventional modular heat exchanging device to reach and detach the cooler that is failed, which is time-consuming. In addition, when the conventional modular heat exchanging device is used in a small system such as a household air conditioner or a portable air conditioner, time for cooling water to flow through the water pipe is relatively short. Thus, heat dissipation efficiency is poor and performance of the system having the conventional modular heat exchanging device is also poor.

To overcome the shortcomings, the present invention provides a modular heat exchanger to mitigate or obviate the aforementioned problems.

SUMMARY OF THE INVENTION

The main objective of the present invention is to provide a modular heat exchanger that includes two finned heat sinks, a securing assembly, a heat conduction pipe, multiple modular blocks, multiple water pipes, and multiple coolers.

The two finned heat sinks form a rectangular cylinder when combined together. Each of the two finned heat sinks has a front side surface, a rear side surface, an inner side surface and an outer side surface. The inner side surface and the outer side surface of each of the finned heat sinks are oppositely defined on said finned heat sink and are disposed between the front side surface and the rear side surface of said finned heat sink. Each of the two finned heat sinks further has multiple guiding plates and a mounting recess. The guiding plates are separately arranged between the front side surface and the rear side surface of said finned heat sink such that multiple independent spaces are formed in said finned heat sink. Each of the independent spaces is defined between two of the guiding plates that are arranged next to each other and is formed through the inner side surface and the outer side surface of said finned heat sink. The mounting recess is formed in the inner side surface of said finned heat sink and communicates with the independent spaces of said finned heat sink. The inner side surface of one of the finned heat sinks is attached to the inner side surface of the other finned heat sink. The mounting recesses of the two finned heat sinks form a mounting chamber. The mounting chamber form a front opening defined on the front side surfaces of the two finned heat sinks and a rear opening defined on the rear side surface of the two finned heat sinks.

The securing assembly includes an upper cover and a lower cover. A receiving chamber is surrounded by the upper cover and the lower cover, and the two finned heat sinks are mounted in the receiving chamber.

The heat conduction pipe, is mounted in the mounting chamber, and is mounted through the front opening and the rear opening. An outer sidewall of the heat conduction pipe abuts on the two heat sinks.

The modular blocks are linearly arranged one after the other. Each of the modular blocks has multiple inlet through holes and multiple outlet through holes. The inlet through holes of each of the modular blocks align with the inlet through holes of an adjacent one of the modular blocks respectively, and the inlet through holes of the modular blocks that align with each other form an inlet channel. The outlet through holes of each of the modular blocks align with the outlet through holes of an adjacent one of the modular blocks respectively, and the outlet through holes of the modular blocks that align with each other form an outlet channel.

Each of the water pipes has two ends. One of the ends of each of the water pipes is mounted through a corresponding one of the inlet channels and abuts against the modular blocks. The other one of the ends of each of the water pipes is mounted through a corresponding one of the outlet channels and abuts against the modular blocks.

The coolers are mounted to an outer sidewall that is defined around the modular blocks. The modular blocks are linearly arranged in the heat conduction pipe. The coolers are attached to an inner sidewall of the heat conduction pipe.

Since the heat exchanger is modular, it is convenient to assemble, disassemble or expand the modular heat exchanger, so as to improve performance of the modular heat exchanger. When one of the coolers fails, it is able to reach and detach said failed cooler by disassembling some parts of the modular heat exchanger, which is convenient and time saving for repairing. Since each of the water pipes is bent into a U shape, time for cooling water to flow through the modular blocks can be increased, thereby improving heat dissipation performance of the modular heat exchanger. Moreover, temperature of each of the coolers is controlled by adjusting voltage input into the coolers. Therefore, the modular heat exchanger provides constant temperature and linear temperature change, and is power saving and quiet during operation.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
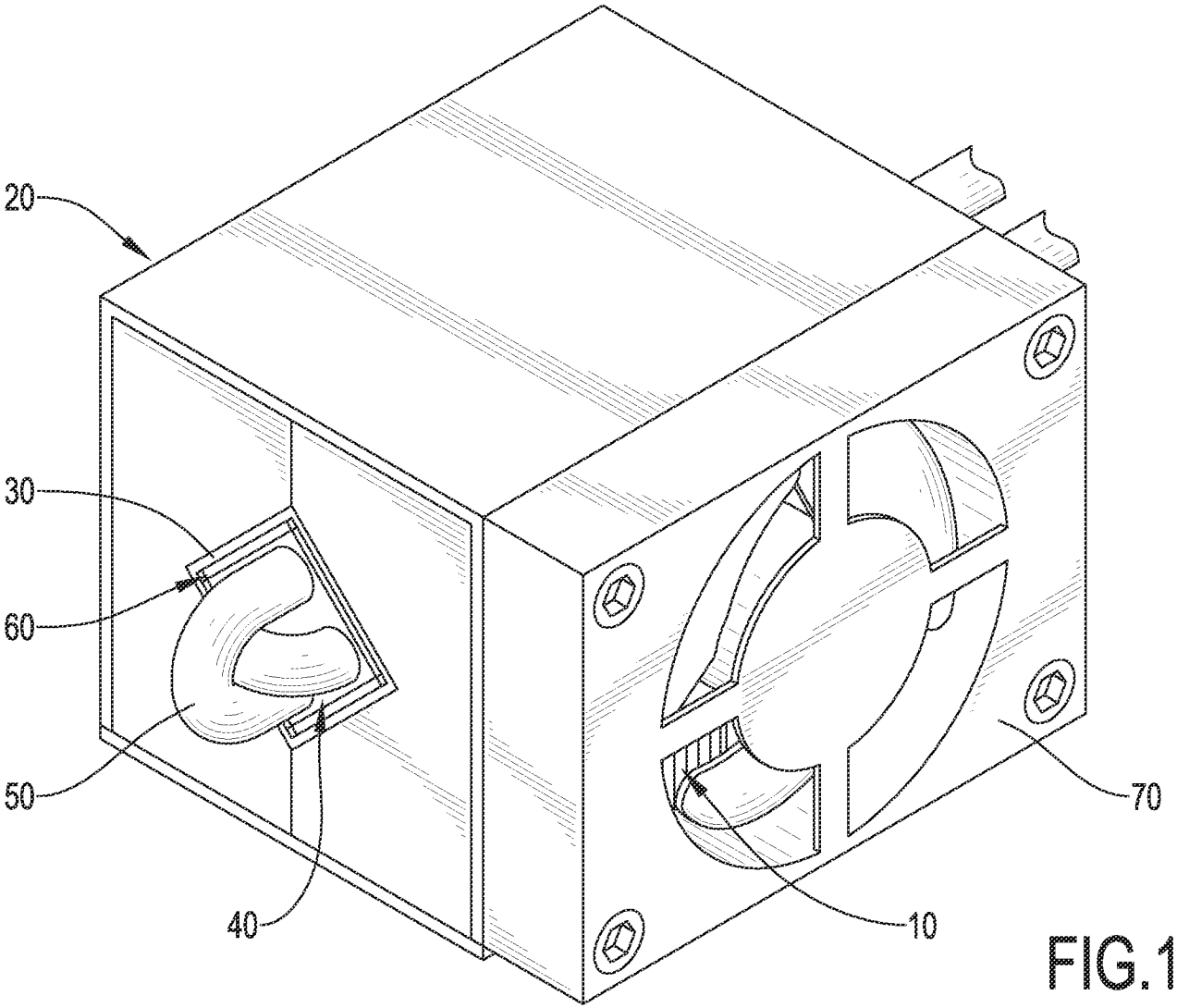
FIG. 1 is a perspective view of a modular heat exchanger in accordance with the present invention.

With reference to FIG. 1, a modular heat exchanger in accordance with the present invention comprises two finned heat sinks 10, a securing assembly 20, a heat conduction pipe 30, multiple modular blocks 40, multiple water pipes 50, multiple coolers 60 and a fan 70.

Figure 2:
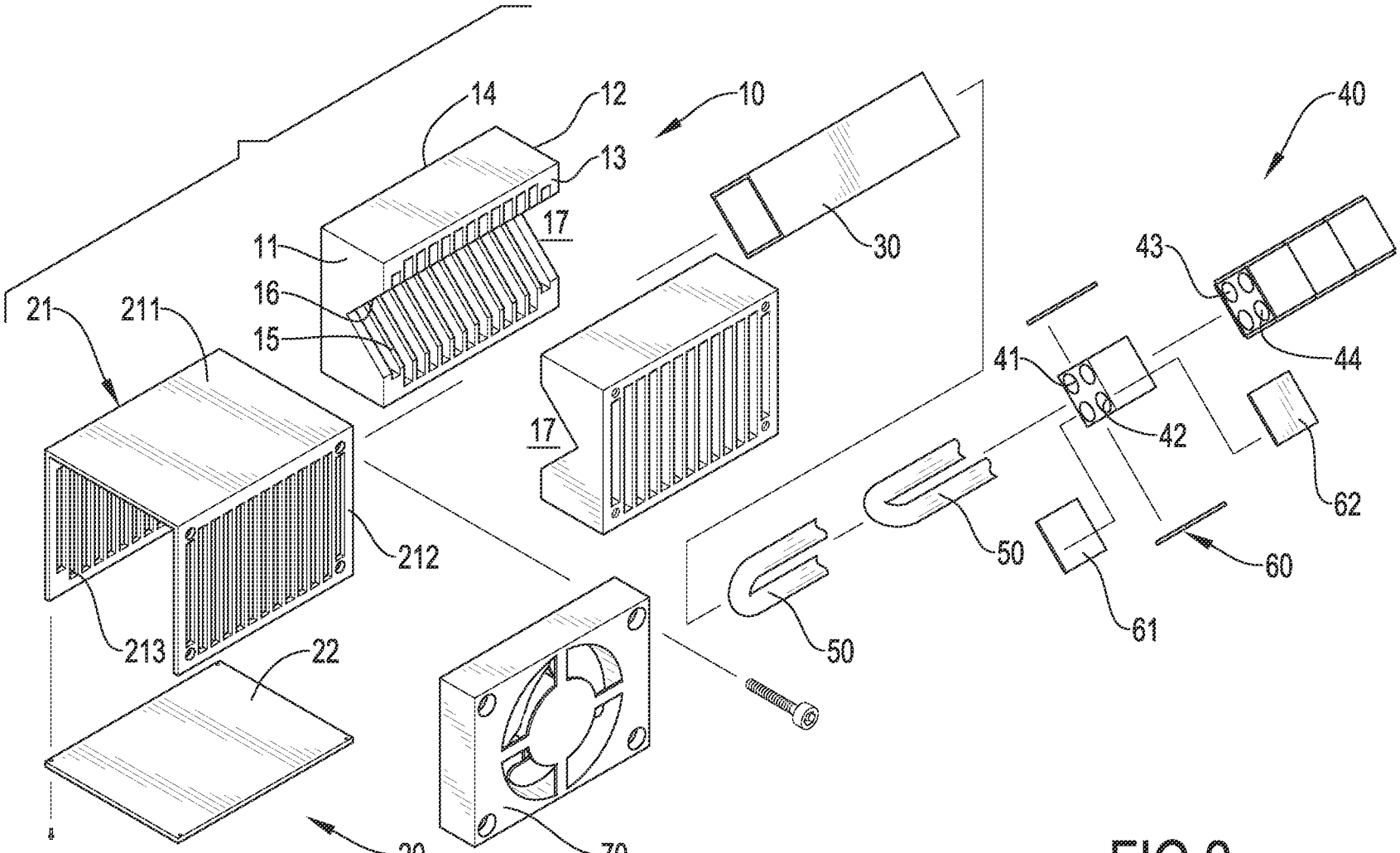
FIG. 2 is an exploded perspective view of the modular heat exchanger in FIG. 1.
Figure 3:
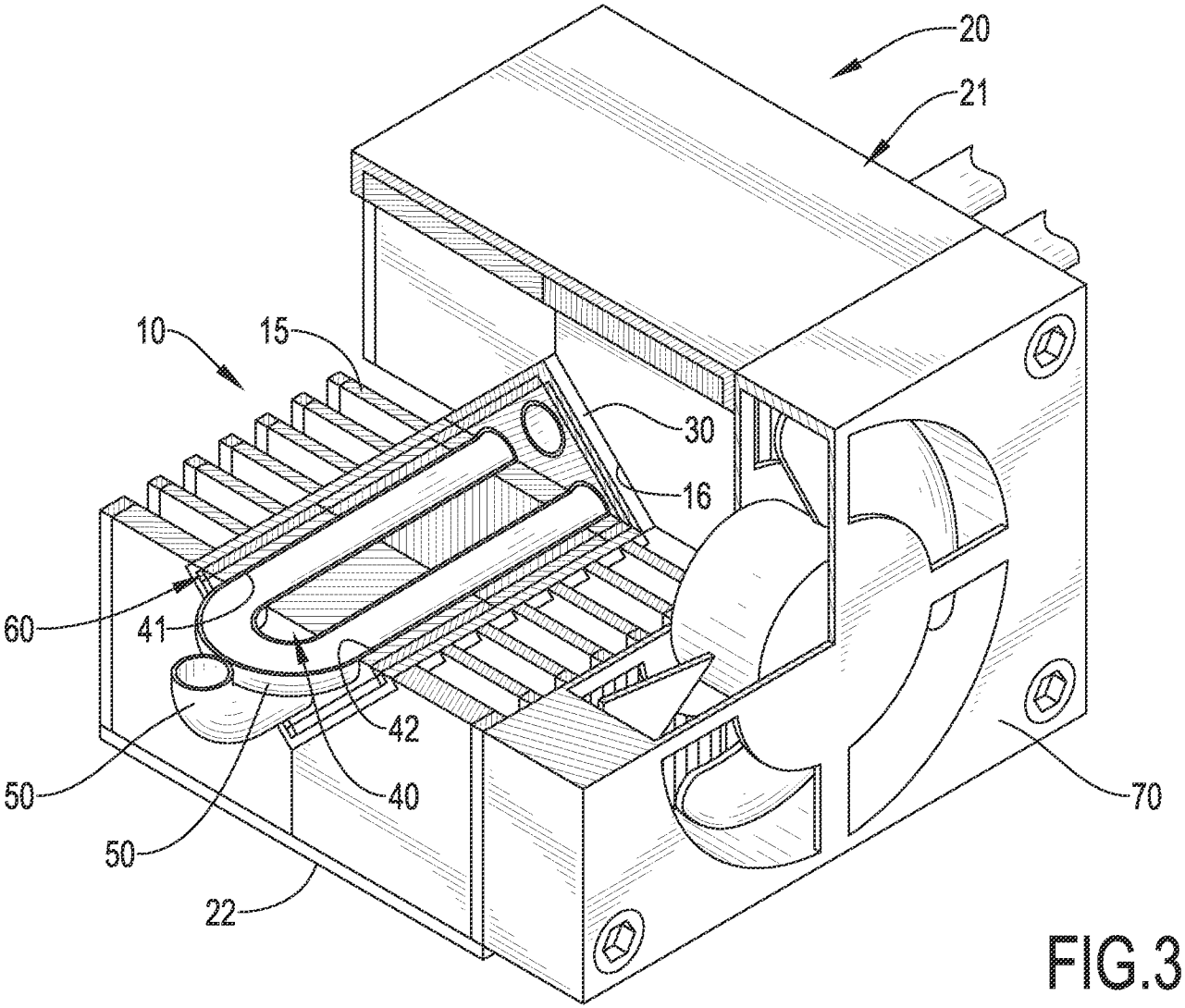
FIG. 3 is a cross-sectional perspective view of the modular heat exchanger in FIG. 1.

With reference to FIGS. 2 and 3, the two finned heat sinks 10 substantially form a rectangular cylinder when combined together. Each of the two finned heat sinks 10 has a front side surface 11, a rear side surface 12, an inner side surface 13, and an outer side surface 14. The inner side surface 13 and the outer side surface 14 of each of the finned heat sinks 10 are oppositely defined on said finned heat sink 10 and are disposed between the front side surface 11 and the rear side surface 12 of said finned heat sink 10. Each of the two finned heat sinks 10 further has multiple guiding plates 15 and a mounting recess 16.

The guiding plates 15 are separately arranged between the front side surface 11 and the rear side surface 12 of said finned heat sink 10, such that multiple independent spaces are formed in said finned heat sink 10. Each of the independent spaces is defined between two of the guiding plates 15 that are arranged next to each other, and is formed through the inner side surface 13 and the outer side surface 14 of said finned heat sink 10.

The mounting recess 16 is formed in the inner side surface 13 and communicates with the independent spaces. The mounting recess 16 is V-shaped in cross-section. However, the shape of the mounting recess 16 is not limited thereto, and may be modified according to a user's needs. The inner side surface 13 of one of the finned heat sinks 10 is attached to the inner side surface 13 of the other finned heat sink 10. The mounting recesses 16 of the two finned heat sinks 10 form a mounting chamber 17 that is rectangular cuboid. The mounting chamber 17 forms a front opening defined on the front side surfaces 11 of the two finned heat sinks 10 and a rear opening defined on the rear side surface 12 of the two finned heat sinks 10.

The securing assembly 20 includes an upper cover 21 and a lower cover 22. The upper cover 21 has a top panel 211, two side panels 212, and multiple venting holes 213. The two side panels 212 extend from two opposites sides of the top panel 212 respectively. The venting holes 213 are formed through the two side panels 212 and correspond in position to the independent spaces of the two finned heat sinks 10 respectively. The lower cover 22 is formed as a sheet and is securely mounted to the upper cover 21 via multiple fasteners. A receiving chamber is surrounded by the upper cover 21 and the lower cover 22. The two finned heat sinks 10 are mounted in the receiving chamber and is held by the securing assembly 20.

Figure 5:
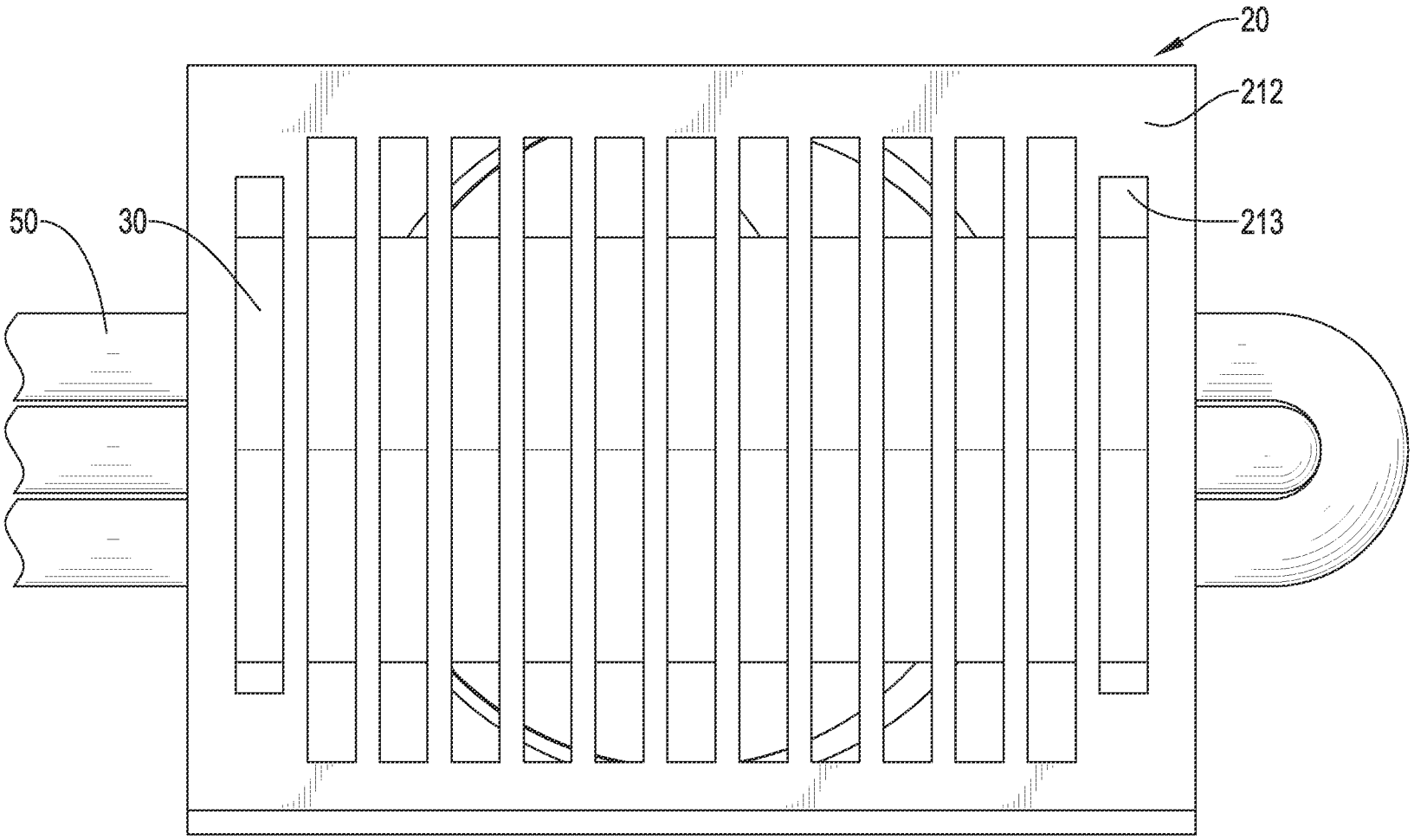
FIG. 5 is a side view of the modular heat exchanger in FIG. 1.

With further reference to FIGS. 2, 3 and 5, the heat conduction pipe 30 is, but is not limited to, a rectangular pipe. The heat conduction pipe 30 is mounted in the mounting chamber 17 that is formed by the mounting recesses 16 of the two finned heat sinks 10, and is mounted through the front opening and the rear opening that are formed on the two finned heat sinks 10. An outer sidewall of the heat conduction pipe 30 abuts on the two heat sinks 10.

Each of the modular blocks 40 is a rectangular block and has multiple inlet through holes 41 and multiple outlet through holes 42. The modular blocks 40 are linearly arranged one after the other. The inlet through holes 41 of each of the modular blocks 40 align with the inlet through holes 41 of an adjacent one of the modular blocks 40 respectively. The inlet through holes 41 of the modular blocks 40 that align with each other form an inlet channel 43, such that a plurality of said inlet channels 43 are formed in the modular blocks 40. The outlet through holes 42 of each of the modular blocks 40 align with the outlet through holes 42 of an adjacent one of the modular blocks 40 respectively. The outlet through holes 42 of the modular blocks 40 that align with each other form an outlet channel 44, such that a plurality of said outlet channels 44 are formed in the modular blocks 40.

In the preferred embodiment, said multiple inlet through holes 41 include two inlet through holes 41 and said multiple outlet through holes 42 include two outlet through holes 42. Each of the inlet through holes 41 is disposed opposite to one of the outlet through holes 42. However, a configuration of the inlet through holes 41 and the outlet through holes 42 is not limited thereto.

Each of the water pipes 50 is U-shaped and has two ends. One of the ends of each of the water pipes 50 is mounted through a corresponding one of the inlet channels 43 and abuts against the modular blocks 40, and the other one of the ends of the water pipes 50 is mounted through a corresponding one of the outlet channels 44 and abuts against the modular blocks 40. In the preferred embodiment, said multiple water pipes 50 includes two water pipes 50 that are arranged crosswise. However, a form of each of the water pipes 50 and an arrangement of the water pipes 50 are not limited thereto, and may be modified according to the user's needs.

Each of the coolers 60 is mounted to an outer sidewall that is defined around the modular blocks 40. In the preferred embodiment, each of the coolers 60 is a thermoelectric cooling chip, is formed as a sheet and has an inner surface 61 and an outer surface 62. The thermoelectric cooling chip is a standard component and a further detailed structure of the thermoelectric cooling chip is omitted.

The inner surface 61 of the coolers 60 is attached to the outer sidewall that is defined on at least one of the modular blocks 40. When the inner surface 61 of each of the cooler 60 is a cold side, the coolers 60 are configured to reduce temperatures of the water pipes 50. However, a configuration of each of the coolers 60 is not limited thereto and can be modified according to the user's needs. The coolers 60 are attached to the outer sidewall that is defined on at least one of the modular blocks 40. Since the modular blocks 40 are linearly arranged in the heat conduction pipe 30, the outer surfaces 62 of the coolers 60 are attached to an inner sidewall of the heat conduction pipe 30.

The fan 70 is mounted to one of the side panels 212 of the upper cover 21 and corresponds in position to the venting holes 213 on said side panel 212. In the preferred embodiment, the fan 70 is, but is not limited to be, mounted to said side panel 212 via multiple fasteners. Otherwise, the fan 70 may be omitted.

Figure 4:
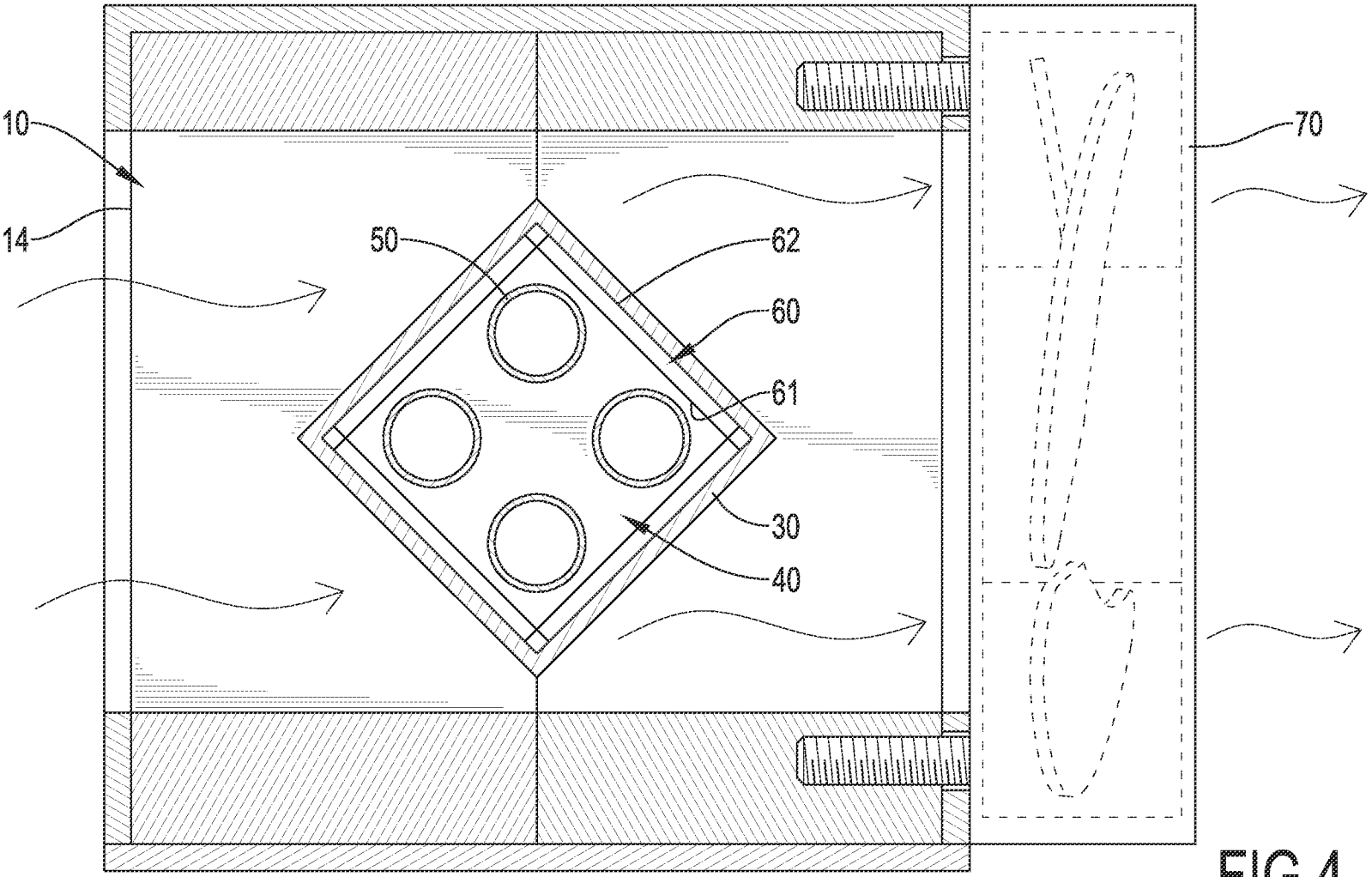
FIG. 4 is a cross-sectional side view of the modular heat exchanger in FIG. 1.

When the modular heat exchanger is in use, a variety of molds, such as transferring heat to or from cold air, warm air, cold water or hot water, are available for implementation. The only difference is that an input fluid is different and temperature of the input fluid is different. With reference to FIG. 4, take the mold for transferring heat to the cold air for instance. The inner surface 61 of each of the coolers 60 is a hot side and is attached to the modular blocks 40, and the outer surface 62 of each of the coolers 60 is a cold side and is attached to the heat conduction pipe 30. Since temperature of the modular blocks 40 increases, temperature of the water pipes 50 increases as well. By inputting cooling water into the water pipes 50 from an end of each of the water pipes 50, the cooling water exchanges heat with the coolers 60 and then is output from another end of each of the water pipes 50. Air is drawn into the finned heat sinks 10 from the outer side surface 14 of one of the finned heat sinks 10 by the fan 70. The air that is drawn into the finned heat sinks 20 exchanges heat with the heat conduction pipe 30 that is at low temperature. Thus, temperature of the air is lowered and is exhausted from the other one of the finned heat sinks 10.

In addition to using one modular heat exchanger alone, multiple modular heat exchangers can also be combined in parallel or in series according to needs of use. A number of the modular blocks 40 can also be changed according to demand. Ways to combine the modular heat exchangers in parallel or in series are conventional techniques, and therefore are omitted.

In the forgoing process, since each of the water pipes 50 is bent into the U shape, time for the cooling water to flow through the modular blocks 40 can be increased, thereby improving heat dissipation performance of the modular heat exchanger.

In the forgoing process, when one of the coolers 60 fails and needs to be repaired, the user disassembles the securing assembly 20 and then removes the finned heat sink 10 that is disposed beside said cooler 60 that needs to be repaired. Thus, the cooler 60 that needs to be repaired can be removed individually without removing the water pipes 50.

Compared with a conventional air conditioner that controls temperature of an output air through start or stop of a compressor, the temperature controlled by the compressor would rise or drop on a sudden. Even if the conventional air conditioner is a variable frequency air conditioner, changes in the temperature of the output air are still noticeable and a lot of electric power would be consumed. Moreover, noise would be generated when the compressor operates. As for the modular heat exchanger of the present invention, temperature of each of the coolers 60 is controlled by adjusting voltage input into the coolers 60. Therefore, the modular heat exchanger of the present invention provides constant temperature and linear temperature change, and is power saving and quiet during operation.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A modular heat exchanger comprising:

two finned heat sinks forming a rectangular cylinder when combined together, and each of the two finned heat sinks having a front side surface, a rear side surface, an inner side surface and an outer side surface; the inner side surface and the outer side surface of each of the finned heat sinks oppositely defined on said finned heat sink and disposed between the front side surface and the rear side surface of said finned heat sink; and each of the two finned heat sinks further having multiple guiding plates separately arranged between the front side surface and the rear side surface of said finned heat sink such that multiple independent spaces are formed in said finned heat sink; each of the independent spaces defined between two of the guiding plates that are arranged next to each other and formed through the inner side surface and the outer side surface of said finned heat sink; and a mounting recess formed in the inner side surface of said finned heat sink and communicating with the independent spaces of said finned heat sink; the inner side surface of one of the finned heat sinks attached to the inner side surface of the other finned heat sink; the mounting recesses of the two finned heat sinks forming a mounting chamber; and the mounting chamber forming a front opening defined on the front side surfaces of the two finned heat sinks and a rear opening defined on the rear side surface of the two finned heat sinks;

a securing assembly including an upper cover and a lower cover, wherein a receiving chamber is surrounded by the upper cover and the lower cover, and the two finned heat sinks are mounted in the receiving chamber;

a heat conduction pipe, mounted in the mounting chamber, and mounted through the front opening and the rear opening, wherein an outer sidewall of the heat conduction pipe abuts on the two heat sinks;

multiple modular blocks linearly arranged one after the other, and each of the modular blocks having multiple inlet through holes, the inlet through holes of each of the modular blocks aligning with the inlet through holes of an adjacent one of the modular blocks respectively, and the inlet through holes of the modular blocks that align with each other forming an inlet channel; and multiple outlet through holes, the outlet through holes of each of the modular blocks aligning with the outlet through holes of an adjacent one of the modular blocks respectively, and the outlet through holes of the modular blocks that align with each other forming an outlet channel;

multiple water pipes, each of the water pipes having two ends, one of the ends of each of the water pipes mounted through a corresponding one of the inlet channels and abutting against the modular blocks, and the other one of the ends of each of the water pipes mounted through a corresponding one of the outlet channels and abutting against the modular blocks; and multiple coolers mounted to an outer sidewall that is defined around the modular blocks; the modular blocks linearly arranged in the heat conduction pipe; and the coolers attached to an inner sidewall of the heat conduction pipe.

2. The modular heat exchanger as claimed in claim 1, wherein the mounting recess of each of the two finned heat sinks is V-shaped in cross-section;

the mounting chamber is rectangular cuboid; and the heat conduction pipe is a rectangular pipe.

3. The modular heat exchanger as claimed in claim 1, wherein the upper cover of the securing assembly has a top panel;

two side panels extending from two opposites sides of the top panel respectively; and multiple venting holes formed through the two side panels and corresponding in position to the independent spaces of the two finned heat sinks respectively; and the lower cover is formed as a sheet and is securely mounted to the upper cover via multiple fasteners.

4. The modular heat exchanger as claimed in claim 2, wherein the upper cover of the securing assembly has a top panel;

two side panels extending from two opposites sides of the top panel respectively; and multiple venting holes formed through the two side panels and corresponding in position to the independent spaces of the two finned heat sinks respectively; and the lower cover is formed as a sheet and is securely mounted to the upper cover via multiple fasteners.

5. The modular heat exchanger as claimed in claim 3 further comprising a fan mounted to one of the side panels of the upper cover and corresponding in position to the venting holes on said side panel.

6. The modular heat exchanger as claimed in claim 4 further comprising a fan mounted to one of the side panels of the upper cover and corresponding in position to the venting holes on said side panel.

* * * * *